US009251929B2

(12) United States Patent
Segawa et al.

(10) Patent No.: US 9,251,929 B2
(45) Date of Patent: Feb. 2, 2016

(54) NON-HALOGEN FLAME-RETARDANT INSULATED WIRE

(71) Applicant: Hitachi Metals, Ltd., Tokyo (JP)

(72) Inventors: Kentaro Segawa, Hitachi (JP); Motoharu Kajiyama, Takahagi (JP)

(73) Assignee: HITACHI METALS, LTD., Tokyo (JP)

( * ) Notice: Subject to any disclaimer, the term of this patent is extended or adjusted under 35 U.S.C. 154(b) by 232 days.

(21) Appl. No.: 13/974,945

(22) Filed: Aug. 23, 2013

(65) Prior Publication Data

US 2014/0083738 A1 Mar. 27, 2014

(30) Foreign Application Priority Data

Sep. 27, 2012 (JP) ..... 2012-213476

(51) Int. Cl.
*H01B 7/00* (2006.01)
*H01B 7/295* (2006.01)
*H01B 13/14* (2006.01)

(52) U.S. Cl.
CPC ..... *H01B 7/295* (2013.01); *H01B 13/148* (2013.01)

(58) Field of Classification Search
USPC ..... 174/110 R–110 PM, 36
See application file for complete search history.

(56) References Cited

U.S. PATENT DOCUMENTS 4,769,179 A * 9/1988 Kato ..... C08K 3/22 252/601
5,418,272 A * 5/1995 Kawabata et al. ..... 524/436
6,242,097 B1 * 6/2001 Nishiguchi et al. ..... 428/383
6,755,995 B1 * 6/2004 Hasegawa et al. ..... 252/609
2007/0149707 A1 * 6/2007 Nakata et al. ..... 525/192
2007/0187130 A1 * 8/2007 Park ..... H02G 3/14 174/68.1
2008/0105454 A1 * 5/2008 Morioka et al. ..... 174/120 SR
2009/0130356 A1 * 5/2009 Moriuchi et al. ..... 428/36.9
2010/0069545 A1 * 3/2010 Gau et al. ..... 524/261
2011/0209898 A1 * 9/2011 Kibe ..... H01B 7/2806 174/113 R

FOREIGN PATENT DOCUMENTS

DE WO02/26879 A1 * 4/2002 ..... C08L 23/04
JP 2003-132741 A 5/2003
JP 2005-200574 * 7/2005 ..... H01B 7/295
JP 2010-097881 * 4/2010 ..... H01B 7/02
JP 2010-097881 A 4/2010

* cited by examiner

*Primary Examiner* — William H Mayo, III
(74) *Attorney, Agent, or Firm* — McGinn IP Law Group, PLLC

(57) ABSTRACT

A non-halogen flame-retardant insulated wire includes a conductor and an insulating coating layer including an inner layer and an outer layer. The inner layer includes a composition in which 50 to 95 parts by weight of a polyethylene with a density of 0.930 g/cm$^3$ or more and 5 to 50 parts by weight of an ethylene copolymer are mixed. The outer layer has a composition including a base polymer in which 60 to 95 parts by weight of an ethylene-vinyl acetate copolymer containing 60% by weight or more of vinyl acetate and 5 to 40 parts by weight of a maleic acid-modified ethylene-α-olefin copolymer are mixed, and including 80 to 200 parts by weight of a metal hydroxide. The outer layer resin composition is crosslinked.

18 Claims, 1 Drawing Sheet

NON-HALOGEN FLAME-RETARDANT INSULATED WIRE

The present application is based on Japanese patent application No. 2012-213476 filed on Sep. 27, 2013, the entire contents of which are incorporated herein by reference.

BACKGROUND OF THE INVENTION

1. Field of the Invention

The present invention relates to an insulated wire, and in particular to a flame-retardant insulated wire which does not contain a halogen compound.

2. Description of the Related Art

Insulated wires provided with flame retardance are widely used in order to prevent fire from easily spreading to insulating coatings of the wires even in the case where flames are caused by abnormalities (e.g., generation of heat and tracking phenomena) at electric connection portions, such as wire joints and electric outlets. Among flame-retardant insulated wires, insulated wires not containing a halogen compound (non-halogen flame-retardant insulated wires) do not generate corrosive halogen gas (e.g., hydrogen chloride) or toxic gas (e.g., dioxin) even when they are burnt, and thus are advantageous in that the burden on the environment and health hazards can be reduced.

Examples of a known resin composition constituting the insulating coating of a non-halogen flame-retardant insulated wire include a resin composition in which a non-halogen flame retardant (e.g., a metal hydroxide, such as magnesium hydroxide) is added and mixed to a polyolefin resin. For example, Japanese Unexamined Patent Application Publication No. 2003-132741 (Patent Document 1) discloses an insulated wire including a conductor, an inner layer covering the conductor, and an outer layer covering the inner layer, in which the inner layer includes a flame-retardant resin composition including a base polymer containing 40 to 90 parts by weight of an ethylene copolymer, 5 to 50 parts by weight of an ethylene-acrylic rubber, and 0.5 to 50 parts by weight of an ionomer or ethylene-methacrylic acid copolymer, and also including 40 to 200 parts by weight of magnesium hydroxide and 1 to 20 parts by weight of a flame retardant promoter relative to 100 parts by weight of the base polymer; and the outer layer includes a resin composition including 100 parts by weight of an ionomer or ethylene-methacrylic acid copolymer, 300 parts by weight or less of magnesium hydroxide, and 20 parts by weight or less of a flame retardant promoter. According to Patent Document 1, after the conductor is covered with the inner layer includes the resin composition having excellent flame retardance and flexibility, the inner layer is covered with the outer layer having excellent abrasion resistance, and therefore, it is possible to provide an insulated wire having excellent abrasion resistance, flame retardance, cold resistance, and mechanical properties.

Furthermore, Japanese Unexamined Patent Application Publication No. 2010-97881 (Patent Document 2) discloses an insulated wire including a conductor, an inner layer covering the conductor, and an outer layer covering the inner layer, in which the inner layer contains an ethylene-ethyl acrylate copolymer (EEA) with an ethyl acrylate content (EA amount) of 10% to 20% by weight and has an insulating property; and the outer layer contains an ethylene-vinyl acetate copolymer (EVA) with a vinyl acetate content (VA amount) of 40% to 50% by weight and a non-halogen flame retardant, is crosslinked, and has oil resistance and flame retardance. According to Patent Document 2, it is possible to provide an insulated wire which does not contain a halogen compound and which has high flame retardance, high mechanical properties, a sufficient insulating property, and high oil resistance.

In recent years, regarding requirements for insulated wires, as the number of kinds of properties required has increased, the required levels of safety, durability, environmental protection, and the like have also increased. For example, in the case of wires for vehicle use, in addition to existing requirements for flame retardance, mechanical properties, and a halogen-free property, excellence in terms of oil resistance, fuel resistance, and cold resistance is also strongly required.

In the insulated wire described in Patent Document 1, in order to obtain high flame retardance, a metal hydroxide is added to each of the inner layer and the outer layer. When the addition amount of the metal hydroxide is increased in accordance with the required flame retardance level, mechanical properties (e.g., elongation of the insulating coating) may be degraded, which is a drawback. Furthermore, in the insulated wire described in Patent Document 2, the latest required levels of oil resistance, fuel resistance, and cold resistance are not necessarily satisfied. In other words, further improvements in the properties of insulated wires (in particular, non-halogen flame-retardant insulated wires) are strongly desired.

SUMMARY OF THE INVENTION

In view of the foregoing and other exemplary problems, drawbacks, and disadvantages of the conventional methods and structures, and an exemplary feature of the present invention is to provide an insulated wire. It is an object of the present invention to provide a non-halogen flame-retardant insulated wire which satisfies all of the various properties required for insulated wires (e.g., flame retardance, mechanical properties, oil resistance, fuel resistance, and an insulating property).

[1] According to one exemplary aspect of the invention, a non-halogen flame-retardant insulated wire includes a conductor and an insulating coating layer disposed on an outer circumference of the conductor, the insulating coating layer including an inner layer and an outer layer. The inner layer includes an inner layer resin composition in which 50 to 95 parts by weight of a polyethylene with a density of 0.930 g/cm$^3$ or more and 5 to 50 parts by weight of an ethylene copolymer are mixed so as to make the total 100 parts by weight. The outer layer includes an outer layer resin composition including a base polymer in which 60 to 95 parts by weight of an ethylene-vinyl acetate copolymer containing 60% by weight or more of vinyl acetate and 5 to 40 parts by weight of a maleic acid-modified ethylene-α-olefin copolymer modified with maleic anhydride are mixed so as to make the total 100 parts by weight, and also including 80 to 200 parts by weight of a metal hydroxide mixed with the base polymer. At least the outer layer resin composition is crosslinked.

[2] In the above exemplary invention [1], many exemplary modifications and changes can be made as below (the following exemplary modifications and changes can be made).

(i) The α-olefin constituting the maleic acid-modified ethylene-α-olefin copolymer is a comonomer having 3 to 8 carbon atoms.

The above exemplary modifications may be alone or in any combination thereof. According to the present invention, it is possible to provide a non-halogen flame-retardant insulated wire which satisfies all of the various properties required for insulated wires (e.g., flame retardance, mechanical properties, oil resistance, fuel resistance, and an insulating property).

[3] An insulated wire according to an embodiment of the present invention includes a conductor; and a non-halogen insulating coating layer surrounding the conductor, the non-halogen insulating coating layer configured to provide all characteristics of mechanical properties of tensile strength and elongation at break, an oil resistance, a fuel resistance, a cold resistance, a flame retardation, and an insulation property.

[4] In the above exemplary invention [3], many exemplary modifications and changes can be made as below (the following exemplary modifications and changes can be made). The non-halogen insulating coating layer comprises:

an inner layer in contact with the conductor, the inner layer comprising a resin composition formed of a polyethylene and an ethylene copolymer; and an outer layer surrounding the inner layer, the outer layer comprising a resin composition formed of a base polymer comprising an ethylene-vinyl acetate copolymer, a maleic acid-modified ethylene-α-olefin copolymer modified with a maleic anhydride, and a metal hydroxide.

[5] In the above exemplary invention [4], the outer layer is crosslinked.

[6] In the above exemplary invention [4], the inner layer resin composition includes 50 to 95 parts by weight of the polyethylene and 5 to 50 parts by weight of the ethylene copolymer.

[7] In the above exemplary invention [6], the polyethylene has a density of at least 0.930 g/cm$^3$.

[8] In the above exemplary invention [6], the inner layer resin composition comprises 60 to 80 parts by weight of the polyethylene and 20 to 40 parts by weight of the ethylene copolymer.

[9] In the above exemplary invention [4], the outer layer resin composition comprises 60 to 95 parts by weight of the ethylene-vinyl acetate copolymer that contains at least 60% by weight of vinyl acetate and 5 to 40 parts by weight of the maleic acid-modified ethylene-α-olefin copolymer modified with the maleic anhydride, to make a total of 100 parts by weight.

[10] In the above exemplary invention [9], the outer layer resin composition further includes 80 to 200 parts by weight of the metal hydroxide.

[11] In the above exemplary invention [9], the outer layer resin composition includes 15 to 35 parts by weight of the maleic acid-modified ethylene-α-olefin copolymer modified with the maleic anhydride.

[12] In the above exemplary invention [9], the maleic acid-modified ethylene-α-olefin copolymer includes a comonomer having three to nine carbon atoms.

[13] In the above exemplary invention [9], the outer layer resin composition further includes at least one of a polyolefin and an ethylene copolymer.

[14] In the above exemplary invention [10], the outer layer resin composition includes 90 to 150 parts by weight of the metal hydroxide.

[15] In the above exemplary invention [4], at least one of the inner layer and the outer layer further includes one or more of an antioxidant, a lubricant, a softener, a plasticizer, an inorganic filler, a compatibilizing agent, a stabilizer, a carbon black, and a coloring agent.

[16] A method of forming an insulated wire, according to an embodiment of the present invention includes heating a conductor wire to a predetermined temperature; and extrusion coating the conductor wire by a non-halogen insulating coating layer configured to provide all characteristics of mechanical properties of tensile strength and elongation at break, an oil resistance, a fuel resistance, a cold resistance, a flame retardation, and an insulation property.

[17] In the above exemplary invention [16], the non-halogen insulating coating layer comprises:

an inner layer in contact with the conductor, the inner layer including a resin composition formed of a polyethylene and an ethylene copolymer; and an outer layer surrounding the inner layer, the outer layer comprising a resin composition formed of a base polymer including an ethylene-vinyl acetate copolymer, a maleic acid-modified ethylene-α-olefin copolymer modified with a maleic anhydride, and a metal hydroxide, and wherein the predetermined temperature is equal to or higher than a melting point of at least the inner layer resin composition.

[18] In the above exemplary invention [17], the wire is extrusion coated sequentially by the inner layer and then the outer layer.

[19] In the above exemplary invention [17], the wire is extrusion coated by the inner layer and the outer layer by a co-extrusion process.

[20] In the above exemplary invention [17], further including crosslinking the outer layer.

BRIEF DESCRIPTION OF THE DRAWINGS

The foregoing and other exemplary purposes, aspects and advantages will be better understood from the following detailed description of the invention with reference to the drawings, in which.

DESCRIPTION OF THE EXEMPLARY EMBODIMENTS

Figure 1A:
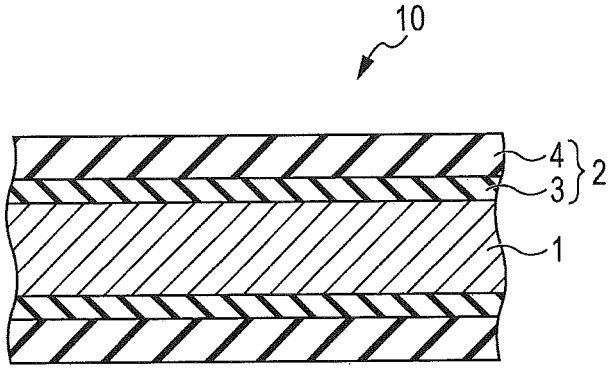
FIGS. 1A and 1B are a longitudinal sectional schematic view and a transverse sectional schematic view, respectively, of a non-halogen flame-retardant insulated wire according to an embodiment of an exemplary aspect of the present invention.
Figure 1B:
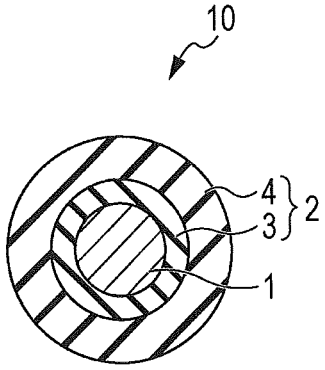

Referring now to the drawings, and more particularly to FIGS. 1A-1B, there are shown exemplary embodiments of the methods and structures according to the present invention.

Although the invention has been described with respect to specific exemplary embodiments for complete and clear disclosure, the appended claims are not to be thus limited but are to be construed as embodying all modifications and alternative constructions that may occur to one skilled in the art which fairly fall within the basic teaching herein set forth.

Further, it is noted that Applicant's intent is to encompass equivalents of all claim elements, even if amended later during prosecution.

However, it is to be understood that the present invention is not limited to the embodiments, and appropriate combinations or improvements are possible within a range that does not deviate from the spirit of the invention.

(Insulated Wire)

FIGS. 1A and 1B are a longitudinal sectional schematic view and a transverse sectional schematic view, respectively, of a non-halogen flame-retardant insulated wire according to an embodiment of an exemplary aspect of the present invention. As shown in FIGS. 1A and 1B, a non-halogen flame-retardant insulated wire 10 according to the present invention includes a conductor 1 made of a metal (for example, with a conductor diameter of 2.47 mm) and an insulating coating layer 2 disposed on the outer circumference of the conductor 1. The insulating coating layer 2 has a two-layered structure including an inner layer 3 (for example, with a thickness of 0.25 mm) and an outer layer 4 (for example, with a thickness of 0.45 mm). The resin compositions constituting the insulating coating layer 2 do not contain a halogen compound, the details of which will be described later. The thickness of the inner layer 3 is preferably 0.05 mm or more from the viewpoint of an electrical insulating property, and the thickness of the outer layer 4 is preferably 0.25 mm or more from the viewpoint of flame retardance.

The material for the conductor 1 is not particularly limited, and any material commonly used for insulated wires (e.g., oxygen-free copper, low-oxygen copper, aluminum, or the like) can be used. In FIGS. 1A and 1B, an example of the conductor 1 which has a circular cross section is shown. However, the conductor 1 is not limited thereto, and the conductor 1 may have a quadrilateral cross section. In the present invention, the term "quadrilateral" includes a square shape having rounded corners and a rectangular shape having rounded corners, as well as square or rectangular shapes with square corners.

(Resin Composition)

The inner layer 3 constituting the insulating coating layer 2 of the non-halogen flame-retardant insulated wire 10 according to the present invention includes an inner layer resin composition in which 50 to 95 parts by weight of a polyethylene (PE) with a density of 0.930 g/cm$^3$ or more and 5 to 50 parts by weight of an ethylene copolymer are mixed so as to make the total 100 parts by weight.

When the density of the polyethylene used is less than 0.930 g/cm$^3$, the inner layer resin composition has low crystallinity and insufficient oil resistance. The mixing amount of the polyethylene is preferably 50 to 95 parts by weight, and more preferably 60 to 80 parts by weight. When the mixing amount of the polyethylene is less than 50 parts by weight, the crystallinity of the inner layer resin composition decreases, resulting in insufficient oil resistance of the insulating coating layer. When the mixing amount exceeds 95 parts by weight, the crystallinity of the inner layer resin composition increases excessively, resulting in insufficient elongation of the insulating coating layer.

Examples of the ethylene copolymer that can be used include low-density polyethylene, medium-density polyethylene, straight-chain low-density polyethylene, straight-chain ultralow-density polyethylene, ethylene-methyl methacrylate copolymers, ethylene-methyl acrylate copolymers, ethylene-vinyl acetate copolymers, ethylene-propylene copolymers, ethylene-butene copolymers, ethylene-octene copolymers, and ethylene-ethyl acrylate copolymers. These ethylene copolymers modified with maleic anhydride or a derivative thereof may also be used. These ethylene copolymers may be used alone or in combination of two or more. The mixing amount of the ethylene copolymer is preferably 5 to 50 parts by weight, and more preferably 20 to 40 parts by weight. When the mixing amount of the ethylene copolymer is less than 5 parts by weight, the elongation of the insulating coating layer decreases. When the mixing amount exceeds 50 parts by weight, the oil resistance of the insulating coating layer decreases.

As long as the effects of the present invention are obtained, a resin other than the polyethylene and the ethylene copolymer can be added to the inner layer resin composition.

The outer layer 4 constituting the insulating coating layer 2 of the non-halogen flame-retardant insulated wire 10 according to the present invention includes an outer layer resin composition including a base polymer in which 60 to 95 parts by weight of an ethylene-vinyl acetate copolymer (EVA) containing 60% by weight or more of vinyl acetate (VA) and 5 to 40 parts by weight of a maleic acid-modified ethylene-α-olefin copolymer modified with maleic anhydride are mixed so as to make the total 100 parts by weight, and also including 80 to 200 parts by weight of a metal hydroxide mixed with the base polymer. The outer layer resin composition is crosslinked.

The vinyl acetate (VA) content of the ethylene-vinyl acetate copolymer (EVA) used is preferably 60% by weight or more. When the VA content in the EVA is less than 60% by weight, the polarity of the outer layer resin composition does not increase sufficiently, resulting in insufficient fuel resistance of the insulating coating layer. Furthermore, the mixing amount of the EVA is preferably 60 to 95 parts by weight, and more preferably 65 to 85 parts by weight. When the mixing amount of the EVA is less than 60 parts by weight, the polarity of the outer layer resin composition does not increase sufficiently, resulting in insufficient fuel resistance of the insulating coating layer. When the mixing amount exceeds 95 parts by weight, the glass transition point of the outer layer resin composition increases, and the cold resistance of the insulating coating layer becomes insufficient.

The mixing amount of the maleic acid-modified ethylene-α-olefin copolymer used is preferably 5 to 40 parts by weight, and more preferably 15 to 35 parts by weight. When the mixing amount of the maleic acid-modified ethylene-α-olefin copolymer is less than 5 parts by weight, adhesion between the base polymer and the metal hydroxide decreases, resulting in insufficient cold resistance of the insulating coating layer. When the mixing amount exceeds 40 parts by weight, adhesion between the base polymer and the metal hydroxide becomes excessively strong, resulting in insufficient elongation of the insulating coating layer.

Furthermore, from the viewpoint of the oil resistance and fuel resistance of the insulating coating layer, the α-olefin constituting the maleic acid-modified ethylene-α-olefin copolymer is preferably a comonomer having 3 to 8 carbon atoms. When the number of carbon atoms of the α-olefin is 2 or less, the rubber elasticity of the copolymer is not sufficiently exerted, resulting in insufficient elongation of the insulating coating layer. When the number of carbon atoms is 9 or more, the crystallinity of the outer layer resin composition decreases, resulting in insufficient oil resistance and fuel resistance of the insulating coating layer.

A polyolefin and an ethylene copolymer may be further added to the base polymer. For example, low-density polyethylene, medium-density polyethylene, high-density polyethylene, straight-chain low-density polyethylene, straight-chain ultralow-density polyethylene, an ethylene-ethyl acrylate copolymer, an ethylene-methacrylate copolymer, an ethylene-styrene copolymer, an ethylene-propylene copolymer, an ethylene-butene copolymer, an ethylene-octene copolymer, or a graft copolymer of any of these polymers with vinylsilane may be additionally used, alone or in combination of two or more.

In the outer layer resin composition, a metal hydroxide serving as a flame retardant is mixed with the base polymer. Examples of the metal hydroxide include magnesium hydroxide, aluminum hydroxide, calcium hydroxide, and these metal hydroxides in which nickel is dissolved as a solid solution. These metal hydroxides may be used alone or in combination of two or more. An appropriate amount of another metal hydroxide may be further added. Furthermore, these meal hydroxides may be surface-treated with a silane coupling agent, a titanate coupling agent, a fatty acid, a metal salt of a fatty acid (e.g., a salt of stearic acid or calcium stearate), or the like.

The mixing amount of the flame retardant is preferably 80 to 200 parts by weight, and more preferably 90 to 150 parts by weight, relative to 100 parts by weight of the base polymer. When the mixing amount of the flame retardant is less than 80 parts by weight, the flame retardance of the insulating coating layer is not sufficient. When the mixing amount exceeds 200 parts by weight, the mechanical properties of the insulating coating layer markedly decrease.

In order to further improve the flame retardance, a flame retardant promoter may be added to such an extent that does not impair other characteristics. Optionally, other additives, such as an antioxidant, a lubricant, a softener, a plasticizer, an inorganic filler, a compatibilizing agent, a stabilizer, carbon black, and a coloring agent, can be added.

At least the outer layer of the insulating coating layer of the insulated wire according to the present invention is exemplary crosslinked. By crosslinking the outer layer resin composition, the mechanical properties of the insulating coating layer are improved. It is more exemplary that, in addition to the outer layer resin composition, the inner layer resin composition be crosslinked.

(Method for Producing Insulated Wire)

An exemplary method for producing a non-halogen flame-retardant insulated wire according to the present invention will be briefly described below. The method for producing the insulated wire of the present invention is not particularly limited as long as a desired structure can be obtained. The insulating coating layer is exemplary formed by extrusion coating. A production method, for example, includes a heating step of heating a conductor 1 to a predetermined temperature, an extrusion coating step of forming an insulating coating layer 2 on the outer circumference of the heated conductor 1 by extrusion coating using the resin compositions described above, and a crosslinking step of crosslinking the insulating coating layer 2.

In the heating step, the predetermined temperature is exemplarity equal to or higher than the melting point of at least the inner layer resin composition. If the temperature of the conductor 1 is lower than the melting point of the inner layer resin composition, when the conductor 1 comes into contact with the inner layer resin composition for coating in the extrusion coating step, the flowability of the inner layer resin composition is decreased, and therefore, adhesion between the conductor 1 and the insulating coating layer 2 becomes insufficient. Note that the heating temperature is set at a temperature that is lower than the decomposition temperature of each of the inner layer resin composition and the outer layer resin composition.

In the extrusion coating step, the insulating coating layer 2 is formed on the outer circumference of the heated conductor 1 by extrusion coating using sufficiently heated and kneaded resin compositions. The insulating coating layer 2 may be formed by a method in which, after the inner layer 3 is formed by extrusion, the outer layer 4 is continuously formed by extrusion on the same production equipment (tandem extrusion), or by a method in which the inner layer 3 and the outer layer 4 are simultaneously formed (co-extrusion).

In the crosslinking step, the crosslinking method is not particularly limited. For example, an electron beam crosslinking method in which electron beam irradiation is performed after the extrusion coating step, or a chemical crosslinking method in which a crosslinking agent is incorporated in advance into the outer layer resin composition, and crosslinking is performed by heating after the extrusion coating step can be used.

EXAMPLES

The present invention will be described more specifically below with reference to examples. However, it is to be understood that the present invention is not limited thereto.

Production of Examples 1 to 10 and Comparative Examples 1 to 9

As inner layer resin compositions, components were mixed as described in Tables 1 to 4 below, and kneading was performed using a pressure kneader (kneading start temperature 40° C., kneading finish temperature 170° C.) to prepare resin pellets. As polyethylenes (PEs), HI-ZEX (registered trademark) 550P (density 0.946 g/cm$^3$), Evolue (registered trademark) SP3510 (density 0.934 g/cm$^3$), and Evolue SP2540 (density 0.924 g/cm$^3$) manufactured by Prime Polymer Co., Ltd. were used. As an ethylene copolymer, an ethylene-ethyl acrylate copolymer (EEA) (REXPEARL (registered trademark) A1150 manufactured by Japan Polyethylene Corporation, ethyl acrylate (EA) content 15%) was used. As a crosslinking aid, trimethylol propane triacrylate (TMPT) (TMPT manufactured by Shin Nakamura Chemical Co., Ltd.) was used. As an antioxidant, a phenolic antioxidant (AO-18 manufactured by ADEKA Corporation) was used. As a lubricant, zinc stearate (EZ101 manufactured by Eishin Kasei K.K.) was used.

As outer layer resin compositions, components were mixed as described in Tables 1 to 4 below, and kneading was performed using a pressure kneader (kneading start temperature 40° C., kneading finish temperature 120° C.) to prepare resin pellets. As ethylene vinyl acetate copolymers (EVAs), Levapren (registered trademark) 900HV (VA amount: about 90% by weight), Levapren 800HV (VA amount: about 80% by weight), Levapren 600HV (VA amount: about 60% by weight), and Levapren 500HV (VA amount: about 50% by weight) manufactured by LANXESS Co., Ltd. were used. As a maleic acid-modified ethylene-α-olefin copolymer, a maleic anhydride-modified ethylene-butene rubber (MA-g-EBR) (TAFMER (registered trademark) MHSO40 manufactured by Mitsui Chemicals, Inc.) was used. An ethylene-butene rubber (EBR) not modified with maleic anhydride (TAFMER (registered trademark) 4085S manufactured by Mitsui Chemicals, Inc.) was also prepared. As a flame retardant, silane-coupling-agent-treated aluminum hydroxide (BF013STV manufactured by Nippon Light Metal Co., Ltd., average particle size: 0.9 μm) was used. As a crosslinking aid, the TMPT (TMPT manufactured by Shin Nakamura Chemical Co., Ltd.) described above was used. As antioxidants, in addition to the phenolic antioxidant (AO-18 manufactured by ADEKA Corporation) described above, a hindered phenolic antioxidant (IRGANOX (registered trademark) 1010 manufactured by BASF Japan Ltd.) was used. As a coloring agent, carbon black (CB) (Asahi Thermal FT manufactured by Asahi Carbon Co., Ltd.) was used. As a lubricant, the zinc stearate (EZ101 manufactured by Katsuta Kako K.K.) was used.

An insulating coating layer was formed on the outer circumference of a conductor (copper wire with an outside diameter of 2.47 mm) by tandem extrusion using a single screw extruder (screw diameter 65 mm), and thereby an insulated wire such as the one shown in FIGS. 1A and 1B was produced. The inner layer was formed at an extrusion temperature of 200° C. with a thickness of 0.25 mm, and the outer layer was formed at an extrusion temperature of 120° C. with a thickness of 0.55 mm. After the extrusion coating step was carried out, the resin compositions of the insulating coating layer were crosslinked by an electron beam crosslinking method in which 13 Mrad electron beam irradiation was performed.

Table 1 shows components of the resin composition (parts by weight) and the structure of the insulated wire in Examples 1 to 5, Table 2 shows components of the resin composition (parts by weight) and the structure of the insulated wire in Examples 6 to 10, Table 3 shows components of the resin composition (parts by weight) and the structure of the insulated wire in Comparative Examples 1 to 5, and Table 4 shows components of the resin composition (parts by weight) and the structure of the insulated wire in Comparative Examples 6 to 9.

TABLE 1

Components of resin composition (parts by weight) and structure of insulated wire in Examples 1 to 5

| Structure | Material | | Example 1 | Example 2 | Example 3 | Example 4 | Example 5 |
|---|---|---|---|---|---|---|---|
| Conductor | Copper wire | Diameter | | | 2.47 mm | | |
| Inner layer | Polymer | PE*1 | 70 | 70 | 70 | 70 | 70 |
| | | PE*2 | | | | | |
| | | EEA*3 | 30 | 30 | 30 | 30 | 30 |
| | Crosslinking aid | TMPT*4 | 1 | 1 | 1 | 1 | 1 |
| | Antioxidant | Phenolic antioxidant*5 | 1.5 | 1.5 | 1.5 | 1.5 | 1.5 |
| | Lubricant | Zinc stearate*6 | 0.2 | 0.2 | 0.2 | 0.2 | 0.2 |
| | Thickness | | | | 0.25 mm | | |
| Outer layer | Polymer | EVA*7 | | | | | 75 |
| | | EVA*8 | 75 | 60 | 95 | | |
| | | EVA*9 | | | | 75 | |
| | | MA-g-EBR*10 | 25 | 40 | 5 | 25 | 25 |
| | Flame retardant | Surface-treated aluminum hydroxide*11 | 120 | 120 | 120 | 120 | 120 |
| | Crosslinking aid | TMPT*4 | 2 | 2 | 2 | 2 | 2 |
| | Antioxidant | Phenolic antioxidant*5 | 1 | 1 | 1 | 1 | 1 |
| | | Hindered phenolic antioxidant*12 | 2 | 2 | 2 | 2 | 2 |
| | Coloring agent | CB*13 | 2 | 2 | 2 | 2 | 2 |
| | Lubricant | Zinc stearate*6 | 1 | 1 | 1 | 1 | 1 |
| | Thickness | | | | 0.55 mm | | |

*1manufactured by Prime Polymer Co., Ltd., HI-ZEX 550P ®, density: 0.946 g/cm$^3$
*2manufactured by Prime Polymer Co., Ltd., Evolue SP3510 ®, density: 0.934 g/cm$^3$
*3manufactured by Japan Polyethylene Corporation, REXPEARL A1150 ®, EA content = 15%
*4manufactured by Shin Nakamura Chemical Co., Ltd., TMPT ®
*5manufactured by ADEKA Corporation, AO-18 ®
*6manufactured by Katsuta Kako K.K., EZ101 ®
*7manufactured by LANXESS Co., Ltd., Levapren 900HV ®, VA amount = 90 wt %
*8manufactured by LANXESS Co., Ltd., Levapren 800 HV ®, VA amount = 80 wt %
*9manufactured by LANXESS Co., Ltd., Levapren 600 HV ®, VA amount = 60 wt %
*10manufactured by Mitsui Chemicals, Inc., TAFMER MH5040 ®
*11manufactured by Nippon Light Metal Co., Ltd., BF013STV ®
*12manufactured by BASF Japan Ltd., IRGANOX 1010 ®
*13manufactured by Asahi Carbon Co., Ltd., Asahi Thermal FT ®

TABLE 2

Components of resin composition (parts by weight) and structure of insulated wire in Examples 6 to 10

| Structure | Material | | Example 6 | Example 7 | Example 8 | Example 9 | Example 10 |
|---|---|---|---|---|---|---|---|
| Conductor | Copper wire | Diameter | | | 2.47 mm | | |
| Inner layer | Polymer | PE*1 | 70 | 70 | 50 | | 95 |
| | | PE*2 | | | | 70 | |
| | | EEA*3 | 30 | 30 | 50 | 30 | 5 |
| | Crosslinking aid | TMPT*4 | 1 | 1 | 1 | 1 | 1 |
| | Antioxidant | Phenolic antioxidant*5 | 1.5 | 1.5 | 1.5 | 1.5 | 1.5 |
| | Lubricant | Zinc stearate*6 | 0.2 | 0.2 | 0.2 | 0.2 | 0.2 |
| | Thickness | | | | 0.25 mm | | |
| Outer layer | Polymer | EVA*7 | | | | | |
| | | EVA*8 | 75 | 75 | 75 | 75 | 75 |
| | | EVA*9 | | | | | |

TABLE 2-continued

| Components of resin composition (parts by weight) and structure of insulated wire in Examples 6 to 10 | | | | | | | |
|---|---|---|---|---|---|---|---|
| Structure | Material | | Example 6 | Example 7 | Example 8 | Example 9 | Example 10 |
| | | MA-g-EBR*10 | 25 | 25 | 25 | 25 | 25 |
| | Flame retardant | Surface-treated aluminum hydroxide*11 | 80 | 200 | 120 | 120 | 120 |
| | Crosslinking aid | TMPT*4 | 2 | 2 | 2 | 2 | 2 |
| | Antioxidant | Phenolic antioxidant*5 | 1 | 1 | 1 | 1 | 1 |
| | | Hindered phenolic antioxidant*12 | 2 | 2 | 2 | 2 | 2 |
| | Coloring agent | CB*13 | 2 | 2 | 2 | 2 | 2 |
| | Lubricant | Zinc stearate*6 | 1 | 1 | 1 | 1 | 1 |
| | Thickness | | | | 0.55 mm | | |

TABLE 3

| Components of resin composition (parts by weight) and structure of insulated wire in Comparative Examples 1 to 5 | | | | | | | |
|---|---|---|---|---|---|---|---|
| Structure | Material | | Comparative Example 1 | Comparative Example 2 | Comparative Example 3 | Comparative Example 4 | Comparative Example 5 |
| Conductor | Copper wire | Diameter | | | 2.47 mm | | |
| Inner layer | Polymer | PE*1 | 70 | 70 | 70 | 96 | 70 |
| | | PE*14 | | | | | |
| | | EEA*3 | 30 | 30 | 30 | 4 | 30 |
| | Crosslinking aid | TMPT*4 | 1 | 1 | 1 | 1 | 1 |
| | Antioxidant | Phenolic antioxidant*5 | 1.5 | 1.5 | 1.5 | 1.5 | 1.5 |
| | Lubricant | Zinc stearate*6 | 0.2 | 0.2 | 0.2 | 0.2 | 0.2 |
| | Thickness | | | | 0.25 mm | | |
| Outer layer | Polymer | EVA*8 | 58 | 96 | | 75 | 75 |
| | | EVA*15 | | | 75 | | |
| | | MA-g-EBR*10 | 42 | 4 | 25 | 25 | |
| | | EBR*16 | | | | | 25 |
| | Flame retardant | Surface-treated aluminum hydroxide*11 | 120 | 120 | 120 | 120 | 120 |
| | Crosslinking aid | TMPT*4 | 2 | 2 | 2 | 2 | 2 |
| | Antioxidant | Phenolic antioxidant*5 | 1 | 1 | 1 | 1 | 1 |
| | | Hindered phenolic antioxidant*12 | 2 | 2 | 2 | 2 | 2 |
| | Coloring agent | CB*13 | 2 | 2 | 2 | 2 | 2 |
| | Lubricant | Zinc stearate*6 | 1 | 1 | 1 | 1 | 1 |
| | Thickness | | | | 0.55 mm | | |

*14manufactured by Prime Polymer Co., Ltd., Evolue SP2540 ®, density: 0.924 g/cm$^3$

*15manufactured by LANXESS Co., Ltd., Levapren 500 HV ®, VA amount = 50 wt %

*16manufactured by Mitsui Chemicals, Inc., TAFMER 4085S ®

TABLE 4

Components of resin composition (parts by weight) and structure of insulated wire in Comparative Examples 6 to 9

| Structure | Material | | Comparative Example 6 | Comparative Example 7 | Comparative Example 8 | Comparative Example 9 |
|---|---|---|---|---|---|---|
| Conductor | Copper wire | Diameter | | 2.47 mm | | |
| Inner layer | Polymer | PE*1 | 70 | 70 | 45 | |
| | | PE*14 | | | | 70 |
| | | EEA*3 | 30 | 30 | 55 | 30 |
| | Crosslinking aid | TMPT*4 | 1 | 1 | 1 | 1 |
| | Antioxidant | Phenolic antioxidant*5 | 1.5 | 1.5 | 1.5 | 1.5 |
| | Lubricant | Zinc stearate*6 | 0.2 | 0.2 | 0.2 | 0.2 |
| | Thickness | | | 0.25 mm | | |
| Outer layer | Polymer | EVA*8 | 75 | 75 | 75 | 75 |
| | | EVA*15 | | | | |
| | | MA-g-EBR*10 | 25 | 25 | 25 | 25 |
| | | EBR*16 | | | | |
| | Flame retardant | Surface-treated aluminum hydroxide*11 | 75 | 210 | 120 | 120 |
| | Crosslinking aid | TMPT*4 | 2 | 2 | 2 | 2 |
| | Antioxidant | Phenolic antioxidant*5 | 1 | 1 | 1 | 1 |
| | | Hindered phenolic antioxidant*12 | 2 | 2 | 2 | 2 |
| | Coloring agent | CB*13 | 2 | 2 | 2 | 2 |
| | Lubricant | Zinc stearate*6 | 1 | 1 | 1 | 1 |
| | Thickness | | | 0.55 mm | | |

The following measurements and evaluations were performed on the insulated wires (Examples 1 to 10 and Comparative Examples 1 to 9) produced as described above.

(1) Evaluation of Mechanical Properties

A tensile test was carried out in accordance with EN 60811-1-1. The insulated wire with a tensile strength of 10 MPa or more and an elongation at break of 150% or more was evaluated as "pass", and the insulated wire with a tensile strength of less than 10 MPa and/or an elongation at break of less than 150% was evaluated as "fail". The results are shown in Tables 5 to 8.

(2) Evaluation of Oil Resistance

An oil resistance test was carried out in accordance with EN 60811-1-3. Insulated wires were heated in a thermostatic chamber set at 100° C. for 72 hours while being immersed in a test oil for oil resistance test (IRM902). After the insulated wires were left to stand at room temperature for 16 hours, the tensile strength and elongation at break were measured by carrying out a tensile test. Evaluations were performed in terms of ratios of the values after the oil immersion and heating to the initial values (tensile strength retention and elongation retention). The insulated wire with a tensile strength retention of 70% or more and an elongation retention of 60% or more was evaluated as "pass", and the insulated wire with a tensile strength retention of less than 70% and/or an elongation retention of less than 60% was evaluated as "fail". The results are also shown in Tables 5 to 8.

(3) Evaluation of Fuel Resistance

A fuel resistance test was carried out in accordance with EN 60811-1-3. Insulated wires were heated in a thermostatic chamber set at 70° C. for 168 hours while being immersed in a test oil for fuel resistance test (IRM903). After the insulated wires were left to stand at room temperature for 16 hours, the tensile strength and elongation at break were measured by carrying out a tensile test. Evaluations were performed in terms of ratios of the values after the fuel immersion and heating to the initial values (tensile strength retention and elongation retention). The insulated wire with a tensile strength retention of 70% or more and an elongation retention of 60% or more was evaluated as "pass", and the insulated wire with a tensile strength retention of less than 70% and/or an elongation retention of less than 60% was evaluated as "fail". The results are also shown in Tables 5 to 8.

(4) Evaluation of Cold Resistance

A low-temperature bending test was carried out in an environment of −40° C. in accordance with EN 60811-1-4 8.1. The insulated wire in which no cracks were caused in the insulating coating layer by low-temperature bending was evaluated as "pass", and the insulated wire in which cracks were caused was evaluated as "fail". The results are also shown in Tables 5 to 8.

(5) Evaluation of Flame Retardance

A vertical flame test was carried out in accordance with Publication 332-1. A gas burner flame was applied to the specimen and removed. The case where the flame was self-extinguished in less than 30 seconds was evaluated as "pass", and the case where the flame was self-extinguished in 30 seconds or more was evaluated as "fail". The results are also shown in Tables 5 to 8.

(6) Evaluation of Insulating Property

A DC stability test was carries out in accordance with EN 50305 6.7. The case where breakdown did not occur was evaluated as "pass", and the case where breakdown occurred was evaluated as "fail". The results are also shown in Tables 5 to 8.

TABLE 5

Various tests and evaluation results in Examples 1 to 5

| | | Examples 1 | Examples 2 | Examples 3 | Examples 4 | Examples 5 |
|---|---|---|---|---|---|---|
| Mechanical properties | Tensile strength (MPa) | 10.7 | 12.7 | 10.2 | 11.7 | 10.1 |
| | Elongation at break (%) | 170 | 151 | 250 | 193 | 167 |
| | Evaluation | Pass | Pass | Pass | Pass | Pass |
| Oil resistance | Tensile strength retention (%) | 86 | 80 | 95 | 83 | 93 |
| | Elongation retention (%) | 88 | 74 | 97 | 84 | 95 |
| | Evaluation | Pass | Pass | Pass | Pass | Pass |
| Fuel resistance | Tensile strength retention (%) | 77 | 72 | 94 | 76 | 91 |
| | Elongation retention (%) | 78 | 61 | 95 | 60 | 94 |
| | Evaluation | Pass | Pass | Pass | Pass | Pass |
| Cold resistance | | Pass | Pass | Pass | Pass | Pass |
| Flame retardance | | Pass | Pass | Pass | Pass | Pass |
| Insulating property | | Pass | Pass | Pass | Pass | Pass |

TABLE 6

Various tests and evaluation results in Examples 6 to 10

| | | Examples 6 | Examples 7 | Examples 8 | Examples 9 | Examples 10 |
|---|---|---|---|---|---|---|
| Mechanical properties | Tensile strength (MPa) | 12.0 | 11.5 | 10.3 | 10.4 | 12.5 |
| | Elongation at break (%) | 273 | 153 | 157 | 180 | 150 |
| | Evaluation | Pass | Pass | Pass | Pass | Pass |
| Oil resistance | Tensile strength retention (%) | 81 | 84 | 71 | 70 | 92 |
| | Elongation retention (%) | 83 | 85 | 71 | 70 | 90 |
| | Evaluation | Pass | Pass | Pass | Pass | Pass |
| Fuel resistance | Tensile strength retention (%) | 74 | 75 | 76 | 77 | 85 |
| | Elongation retention (%) | 71 | 72 | 74 | 75 | 76 |
| | Evaluation | Pass | Pass | Pass | Pass | Pass |
| Cold resistance | | Pass | Pass | Pass | Pass | Pass |
| Flame retardance | | Pass | Pass | Pass | Pass | Pass |
| Insulating property | | Pass | Pass | Pass | Pass | Pass |

TABLE 7

Various tests and evaluation results in Comparative Examples 1 to 5

| | | Comparative Example 1 | Comparative Example 2 | Comparative Example 3 | Comparative Example 4 | Comparative Example 5 |
|---|---|---|---|---|---|---|
| Mechanical properties | Tensile strength (MPa) | 12.5 | 10.0 | 12.0 | 12.7 | 10.6 |
| | Elongation at break (%) | 147 | 257 | 200 | 148 | 193 |
| | Evaluation | Fail | Pass | Pass | Fail | Pass |
| Oil resistance | Tensile strength retention (%) | 79 | 99 | 79 | 93 | 84 |
| | Elongation retention (%) | 72 | 96 | 72 | 89 | 86 |
| | Evaluation | Pass | Pass | Pass | Pass | Pass |
| Fuel resistance | Tensile strength retention (%) | 70 | 97 | 73 | 86 | 76 |

TABLE 7-continued

| Various tests and evaluation results in Comparative Examples 1 to 5 | | | | | |
|---|---|---|---|---|---|
| | Comparative Example 1 | Comparative Example 2 | Comparative Example 3 | Comparative Example 4 | Comparative Example 5 |
| Elongation retention (%) | 58 | 96 | 59 | 77 | 79 |
| Evaluation | Fail | Pass | Fail | Pass | Pass |
| Cold resistance | Pass | Fail | Pass | Pass | Fail |
| Flame retardance | Pass | Pass | Pass | Pass | Pass |
| Insulating property | Pass | Pass | Pass | Pass | Pass |

TABLE 8

| Various tests and evaluation results in Comparative Examples 6 to 9 | | | | | |
|---|---|---|---|---|---|
| | | Comparative Example 6 | Comparative Example 7 | Comparative Example 8 | Comparative Example 9 |
| Mechanical properties | Tensile strength (MPa) | 12.3 | 11.6 | 10.2 | 10.0 |
| | Elongation at break (%) | 263 | 147 | 157 | 197 |
| | Evaluation | Pass | Fail | Pass | Pass |
| Oil resistance | Tensile strength retention (%) | 82 | 85 | 69 | 68 |
| | Elongation retention (%) | 81 | 82 | 70 | 69 |
| | Evaluation | Pass | Pass | Fail | Fail |
| Fuel resistance | Tensile strength retention (%) | 75 | 74 | 75 | 77 |
| | Elongation retention (%) | 73 | 75 | 74 | 72 |
| | Evaluation | Pass | Pass | Pass | Pass |
| Cold resistance | | Pass | Pass | Pass | Pass |
| Flame retardance | | Fail | Pass | Pass | Pass |
| Insulating property | | Pass | Pass | Pass | Pass |

Description will be made on the examples of the present invention with reference to Tables 1 and 2 and Tables 5 and 6. Examples 1 to 10 which satisfy the provisions of the present invention pass all of the requirements for mechanical properties (tensile strength and elongation at break), oil resistance, fuel resistance, cold resistance, flame retardance, and an insulating property, and thus it is confirmed that they exhibit good properties.

Next, description will be made on the comparative examples with reference to Tables 3 and 4 and Tables 7 and 8. In Comparative Example 1, the mixing amount of the EVA in the outer layer resin composition is 58 parts by weight which is lower than the range specified in the present invention (60 to 95 parts by weight). As a result, the fuel resistance is unsatisfactory. On the other hand, in Comparative Example 2, the mixing amount of the EVA in the outer layer resin composition is 96 parts by weight which is higher than the range specified in the present invention. As a result, the cold resistance is unsatisfactory.

In Comparative Example 3, the VA content of the EVA used in the outer layer resin composition is 50% by weight which is lower than the range specified in the present invention (60% by weight or more). As a result, the fuel resistance is unsatisfactory.

In Comparative Example 5, an EBR not modified with maleic anhydride is used in the outer layer resin composition. As a result, the cold resistance is unsatisfactory.

In Comparative Example 6, the addition amount of magnesium hydroxide in the outer layer resin composition is 75 parts by weight which is lower than the range specified in the present invention (80 to 200 parts by weight). As a result, the flame retardance is unsatisfactory. On the other hand, in Comparative Example 7, the addition amount of magnesium hydroxide in the outer layer resin composition is 210 parts by weight which is higher than the range specified in the present invention. As a result, the elongation at break is unsatisfactory.

In Comparative Example 4, the mixing amount of the ethylene copolymer in the inner layer resin composition is 4 parts by weight which is lower than the range specified in the present invention (5 to 50 parts by weight). As a result, elongation is unsatisfactory.

In Comparative Example 8, the mixing amount of the PE in the inner layer resin composition is 45 parts by weight which is lower than the range specified in the present invention (50 to 95 parts by weight). As a result, the oil resistance is unsatisfactory.

In Comparative Example 9, the density of the PE used in the inner layer resin composition is 0.924 g/cm$^3$ which is lower than the range specified in the present invention (0.930 g/cm$^3$ or more). As a result, the oil resistance is unsatisfactory.

As is evident from the above description, the non-halogen flame-retardant insulated wires according to the present invention do not contain a halogen compound and satisfy all of the various properties required for insulated wires (e.g., flame retardance, mechanical properties, oil resistance, fuel resistance, and an insulating property).

What is claimed is:

1. A non-halogen flame-retardant insulated wire, comprising:

a conductor; and an insulating coating layer disposed on an outer circumference of the conductor, the insulating coating layer including an inner layer and an outer layer, wherein the inner layer comprises an inner layer resin composition in which 50 to 95 parts by weight of a polyethylene with a density of 0.930 g/cm$^3$ or more and 5 to 50 parts by weight of an ethylene copolymer are mixed so as to make the total 100 parts by weight, wherein the outer layer comprises an outer layer resin composition comprising a base polymer in which 60 to 95 parts by weight of an ethylene-vinyl acetate copolymer containing 60% by weight or more of vinyl acetate and 5 to 40 parts by weight of a maleic acid-modified ethylene-α-olefin copolymer modified with maleic anhydride are mixed so as to make the total 100 parts by weight, and also including 80 to 200 parts by weight of a metal hydroxide mixed with the base polymer, and wherein at least the outer layer resin composition is crosslinked.

2. The non-halogen flame-retardant insulated wire according to claim 1, wherein the α-olefin constituting the maleic acid-modified ethylene-α-olefin copolymer comprises a comonomer comprising 3 to 8 carbon atoms.

3. An insulated wire, comprising:

a conductor; and a non-halogen insulating coating layer surrounding the conductor, the non-halogen insulating coating layer comprising:

an inner layer in contact with the conductor, the inner layer comprising a resin composition comprising a polyethylene and an ethylene copolymer; and an outer layer surrounding the inner layer, the outer layer comprising a resin composition comprising a base polymer comprising an ethylene-vinyl acetate copolymer, wherein the ethylene-vinyl acetate copolymer contains at least 60% by weight of vinyl acetate.

4. The insulated wire of claim 3, wherein the outer layer is crosslinked.

5. The insulated wire of claim 3, wherein the inner layer resin composition comprises 50 to 95 parts by weight of the polyethylene and 5 to 50 parts by weight of the ethylene copolymer.

6. The insulated wire of claim 5, wherein the polyethylene has a density of at least 0.930 g/cm$^3$.

7. The insulated wire of claim 5, wherein the inner layer resin composition comprises 60 to 80 parts by weight of the polyethylene and 20 to 40 parts by weight of the ethylene copolymer.

8. The insulated wire of claim 3, wherein the outer layer resin composition comprises 5 to 40 parts by weight of the maleic acid-modified ethylene-α-olefin copolymer modified with the maleic anhydride, to make a total of 100 parts by weight, and wherein the outer layer resin composition comprises 5 to 40 parts by weight of the maleic acid-modified ethylene-α-olefin copolymer modified with the maleic anhydride, to make a total of 100 parts by weight.

9. The insulated wire of claim 8, wherein the outer layer resin composition further comprises 80 to 200 parts by weight of the metal hydroxide.

10. The insulated wire of claim 9, wherein the outer layer resin composition comprises 90 to 150 parts by weight of the metal hydroxide.

11. The insulated wire of claim 8, wherein the outer layer resin composition comprises 15 to 35 parts by weight of the maleic acid-modified ethylene-α-olefin copolymer modified with the maleic anhydride.

12. The insulated wire of claim 8, wherein the maleic acid-modified ethylene-α-olefin copolymer comprises a comonomer including three to nine carbon atoms.

13. The insulated wire of claim 8, wherein the outer layer resin composition further comprises at least one of a polyolefin and an ethylene copolymer.

14. The insulated wire of claim 3, wherein at least one of the inner layer and the outer layer further includes one or more of an antioxidant, a lubricant, a softener, a plasticizer, an inorganic filler, a compatibilizing agent, a stabilizer, a carbon black, and a coloring agent.

15. A method of forming an insulated wire, said method comprising:

heating a conductor wire to a predetermined temperature; and extrusion coating the conductor wire by a non-halogen insulating coating layer comprising:

an inner layer in contact with the conductor, the inner layer comprising a resin composition comprising a polyethylene and an ethylene copolymer; and an outer layer surrounding the inner layer, the outer layer comprising a resin composition comprising a base polymer comprising an ethylene-vinyl acetate copolymer containing at least 60% by weight of vinyl acetate, a maleic acid-modified ethylene-α-olefin copolymer modified with a maleic anhydride, and a metal hydroxide, wherein the predetermined temperature is equal to or higher than a melting point of at least the inner layer resin composition.

16. The method of claim 15, wherein the wire is extrusion coated sequentially by the inner layer and then the outer layer.

17. The method of claim 15, wherein the wire is extrusion coated by the inner layer and the outer layer by a co-extrusion process.

18. The method of claim 15, further comprising crosslinking the outer layer.

* * * * *